United States Patent [19]

Blanquet

[11] 4,395,897

[45] Aug. 2, 1983

[54] ROLLING HEAD SUPPORT ASSEMBLY FOR A ROLLING MILL

[75] Inventor: Claude Blanquet, Berlaimont, France

[73] Assignee: Vallourec, Paris, France

[21] Appl. No.: 265,485

[22] Filed: May 20, 1981

[30] Foreign Application Priority Data

May 23, 1980 [FR] France ..... 80 11526

[51] Int. Cl.[3] ..... B21B 25/02; B21B 25/06

[52] U.S. Cl. ..... 72/97; 72/96; 72/209

[58] Field of Search ..... 72/96, 97, 208, 209, 72/368, 479

[56] References Cited

U.S. PATENT DOCUMENTS 2,024,514 12/1935 Diescher ..... 72/208
3,722,246 3/1973 Passoni ..... 72/208
4,037,449 7/1977 Schuetz ..... 72/209

FOREIGN PATENT DOCUMENTS 55-68105 5/1980 Japan ..... 72/208

*Primary Examiner*—Lowell A. Larson
*Attorney, Agent, or Firm*—Pollock, Vande Sande & Priddy

[57] ABSTRACT

In a rolling mill having a perforating head supported on a bar which is rotatable and longitudinally displaceable, the bar is supported on a carriage by way of a gripper fixed to the carriage and engaging a recess in the bar with sufficient radial play to allow rotation of the bar. The recess also affords axial clearance so that the rolling reaction on the perforating head displaces the rear end of the bar into abutment with a planar end contact face of a rotating bearing. The abutment of the end of the bar against the contact face allows the bar to be ejected laterally without previous axial disengagement of the bar from the bearing.

5 Claims, 2 Drawing Figures

ROLLING HEAD SUPPORT ASSEMBLY FOR A ROLLING MILL

The invention relates to rolling techniques, in which a bar supporting a rolling head is used, and it applies, in particular, to perforating rolls, roughing rolls, stretching rolls and finishing rolls.

In perforating techniques for converting a solid block into a tubular blank, in a rolling mill, in which techniques use is made of a bar supporting a perforating head, to push this head into the block to convert the latter into a hollow tube, the perforating bar must be maintained in the axis of the perforating roll;

driven to rotate about itself and;

displaceable in the direction of the perforating roll.

For this purpose, it is known to assign to the bar, on the one hand, a bearing, and on the other hand, a gripper, the jaws of the gripper being supported in a lateral recess of the bar and the bearing being inserted in the rear end of the bar. The assembly consisting of the gripper and the bearing is supported by a carriage which can undergo translational movement in the direction of the perforating roll, said assembly also being driven to rotate on itself at a speed substantially equal to, but still lower than the speed of rotation of the product. A free wheel provided in the rotation control system enables the assembly to assume without difficulty the actual speed determined by the product during the perforating operation.

At the end of a perforating operation, the bar, to which the perforated blank is attached, is disengaged axially from the roll, together with its carriage, and is separated from the bearing, so as to be recycled for a new perforating operation, after being stripped of the blank which continues its production cycle.

To separate the bar, provided with its blank, from the bearing, it is necessary to displace it axially again in a direction opposite to the preceding direction, so as to release the engagement, during which displacement the rolling mill cannot be used.

The object of the present invention is to reduce this idle time to increase production, while meeting the requirements of aligning and displacing the bar and of driving in rotation during the perforating operation.

This is achieved, according to the invention, by mounting the gripper so that it is fixed, i.e., non-rotating on the carriage, and by replacing the positive connection between the rotating bearing and the bar by a simple contact between faces of the bearing and of the bar, permitting lateral ejection of the bar relative to the bearing, without previous axial disengagement.

The bar and the bearing are preferably in contact by means of plane faces.

The time necessary for a change of bar can be reduced, in this way, e.g., from 7 to 5 seconds.

The invention also makes it possible to avoid the use of means such as a central ejection fork or bar, which were necessary in the prior art to eject the bar, thus making the equipment simpler.

In the technique of the invention, the bar normally possesses a recess to receive the jaws of the gripper; these jaws are applied in the recess with radial play to enable the bar to rotate relative to the jaws. Moreover, they are applied in the recess with an axial play, so that they serve to hold the bearing end of the bar in the immediate vicinity of the bearing bush of the carriage only during the phases of translational movement of the latter, i.e., when the bar is introduced axially into the rolling mill before the start of the perforating operation and, subsequently, when the bar is extracted axially from the rolling mill, once the perforating operation has terminated.

Thus, right from the start of the perforating operation, the product driven by the rolls of the perforating rolling mill makes contact with the perforating point integral with the bar and can push the whole assembly back forcibly against the bearing bush of the carriage previously made to rotate. Perforating begins immediately, and the effect of the resulting development of axial reactions on the bar is to apply said bar forcibly against the bearing bush, as a result of which the bar is made to rotate almost immediately under the combined effect of the rotating product and of the bearing bush previously made to rotate. Because of the axial speed of the product to be perforated (several dm per second) and because of the short distance separating the end of the bar from the bearing bush (a few cm), this phase is extremely brief, and, in practice, in terms of the rolling results, everything takes place as though the bar were instantaneously made to rotate.

Preferably, the bearing is designed with a bearing bush which is sufficiently bulky to assure that the heat generated during the very brief period of making contact is dissipated in the mass of the bush and is not radiated outwards, thus limiting the temperature in the region of contact.

An embodiment of the bearing device for a perforating bar, according to the invention, for a perforating rolling mill with recycling of the bar, is described below with reference to the attached drawings, in which.

Figure 1:
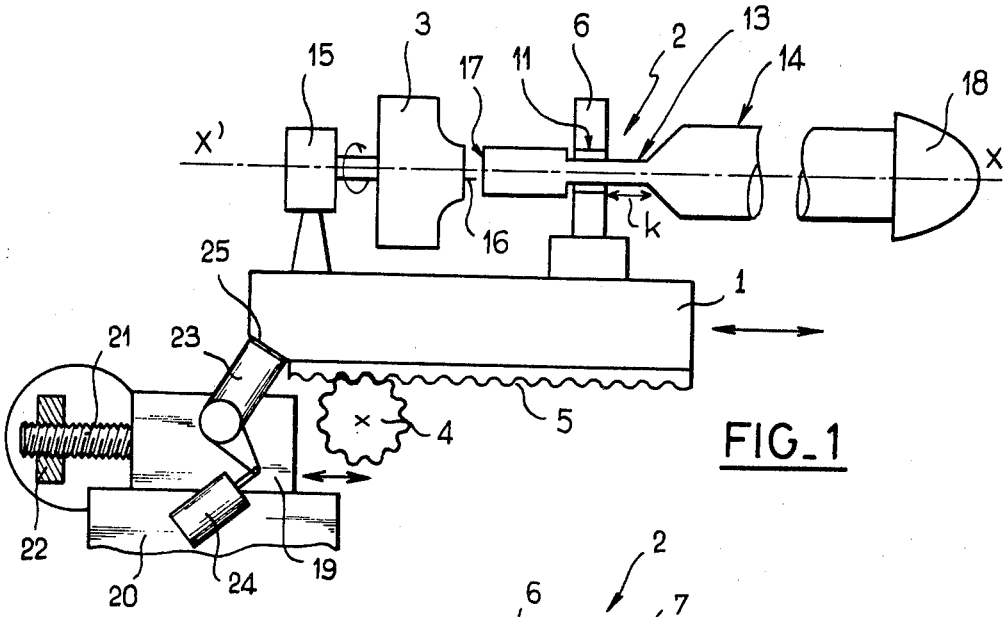
FIG. 1 is a diagrammatic longitudinal axial view of the device.

The device illustrated in the Figures comprises a carriage 1 which supports a gripper 2 and a bearing 3.

The carriage is displaceable by translational movement, in a direction parallel to the axis XX' of the perforating rolling mill (the latter is not shown and is located on the right-hand side), said displacement being obtained, for example, by means of a rack 5 and pinion 4 system, the rotation of the pinion being controlled by means of a motor (not shown).

This drive system, known per se, is not restrictive, and the invention is not concerned with the details of the means of driving the carriage.

Figure 2:
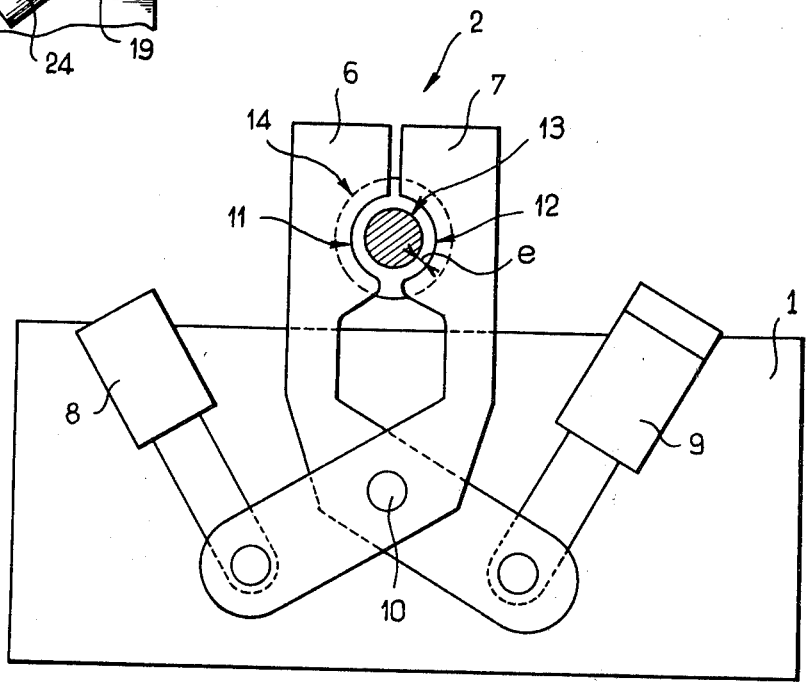
FIG. 2 is a cross-section in the region of the gripper of the device.

The gripper 2 is fixed (i.e., non-rotating) on the carriage, but its two arms 6, 7 (FIG. 2) are displaceable by pivoting, under the action of respective jacks 8,9, about a pivot 10, common to both or not, between an operating position (as shown) and a retracted position.

In the operating position, the jaws 11,12 of the two arms of the gripper end in a recess 13 of the perforating bar 14 (FIG. 1), with a radial play e of the order of 2 mm and with an axial play k of the order of 5 to 10 mm.

The invention is not restricted to a particular type of gripper.

The bearing 3 is driven to rotate on the carriage about the axis X'X by means of a motor 15 which is supported by the carriage or is independent. The axial play k of the gripper is designed to enable the bearing face 16 of the bearing bush and the rear end face 17 of the bar to approach one another up to contact or to separate from one another.

At its other end the bar supports a pear-shaped perforating head 18.

These faces are preferably plane to make lateral disengagement as easy as possible, without axial displacement of the bar, when the bar is changed.

The flat bearing is driven to rotate at a speed of 1,000 to 1,500 rpm, the speed preferably being selected slightly lower than the theoretical speed of the bar in operation, for example 90% of the latter, so that the friction between the bar and bearing, at the moment when they come in contact with one another, causes heating only to an acceptable level.

The bar comes in contact with the bearing, not by means of a positive connection, as in the prior art, but under the effect of the rolling reactions during perforation.

When the bar has been positioned in the axis of the perforator by known means and when the carriage is moved axially to bring the perforating point into a suitable position for perforation between the two rolls of the rolling mill, the gripper prevents dislocation under shock at the moment of contact, and it subsequently assures disengagement from the rolling mill, once the perforation has been terminated.

The device also possesses known means for locking the carriage 1 in the rolling position.

These means, which are not part of the present invention, consist, for example, of a block 19 which can slide parallel to the axis xx' on a pedestal 20 and the position of which can be adjusted continuously by means of a threaded rod 21 which moves in a fixed threaded block 22. A retractable wedge 23 controlled by a jack 24 bears, in its working position, on a face 25, provided for this purpose, of the carriage 1.

The device also possesses, as known devices (not shown) units for guiding the bar, between the carriage and the perforating rolling mill, as well as means for the lateral removal of the bar and of the blank surrounding it, once the perforation has been performed, and means for introducing the bar intended for the following perforating operation.

In the case of a perforating rolling mill producing blanks having an outside diameter of the order of 170 mm, the above-described device has made it possible to change the time between two perforating operations from 12 to 15 to 6.7 seconds, a time saving of 6 to 8 seconds, representing an overall increase in productivity of the order of 25%.

As an indication, the assembly consisting of the pear-shaped perforating head and the bar can weigh 350 to 1,800 kg, the total mass of the carriage being 6,000 kg and that of the actual bearing bush 9.5 to 11.5 kg.

Although the invention has been described for the particular case of a perforating rolling mill, it applies to any roughing, stretching and/or finishing rolling mill in which use is made of a bar supporting a rolling head and in which the same problem arises as that described here with regard to the perforating rolling mill.

I claim:

1. A gripper and bearing assembly for supporting the rear end of a bar having a rolling head at its other end, comprising (a) a carriage supporting said bar for longitudinal displacement;

(b) a bearing having a flat contact face and being mounted on said carriage and engageable with said rear end of said bar;

(c) means for rotatably driving said bearing; and (d) gripper means mounted on said carriage and engageable in a recess in said bar;

(e) said rear end of said bar having a flat face for directly contacting said flat contact face of said bearing;

(f) whereby said bar can be laterally ejected without prior axial disengagement of said bar from said bearing.

2. An assembly as claimed in claim 1, wherein there is radial play between said gripper and said bar.

3. An assembly as claimed in claim 1, wherein there is axial play between said gripper and said bar.

4. An assembly as claimed in claim 1, wherein there is radial and axial play between said gripper and said bar.

5. An assembly as claimed in claim 1, wherein said bearing is dimensioned to assure that the heat generated during the period of making contact with said bar is dissipated in the mass of said bearing.

* * * * *